US010340051B2

(12) United States Patent
Pärnaste et al.

(10) Patent No.: US 10,340,051 B2
(45) Date of Patent: Jul. 2, 2019

(54) RADIOISOTOPE PRODUCTION SYSTEM AND METHOD FOR CONTROLLING THE SAME

(71) Applicant: General Electric Company, Schenectady, NY (US)

(72) Inventors: Martin Pärnaste, Uppsala (SE); Mikael Carlbom, Uppsala (SE); Rickard Ericson, Uppsala (SE); John Melin, Uppsala (SE)

(73) Assignee: General Electric Company, Schenectady, NY (US)

( * ) Notice: Subject to any disclaimer, the term of this patent is extended or adjusted under 35 U.S.C. 154(b) by 420 days.

(21) Appl. No.: 15/044,397

(22) Filed: Feb. 16, 2016

(65) Prior Publication Data

US 2017/0236608 A1 Aug. 17, 2017

(51) Int. Cl.
*G21G 1/10* (2006.01)
*H05H 7/04* (2006.01)
(Continued)

(52) U.S. Cl.
CPC ..... *G21G 1/10* (2013.01); *H05H 7/001* (2013.01); *H05H 7/04* (2013.01); *H05H 13/005* (2013.01);
(Continued)

(58) Field of Classification Search
CPC ... H05H 13/005; H05H 7/04; H05H 2277/116
See application file for complete search history.

(56) References Cited

U.S. PATENT DOCUMENTS 6,178,032 B1 * 1/2001 Huang ..... G02F 1/0123 359/237
7,122,966 B2 10/2006 Norling
(Continued)

FOREIGN PATENT DOCUMENTS

WO 2009097536 A1 8/2009
WO WO-2009097536 A1 * 8/2009 ..... H05H 7/00

OTHER PUBLICATIONS

Ehlers, K. W. "Conceptual design of a neutral-beam injection system for the TFTR." (1975). available online: <https://cloudfront.escholarship.org/dist/prd/content/qt6jw00640/qt6jw00640.pdf>. (Year: 1975).*

(Continued)

*Primary Examiner* — Lily C Garner
(74) *Attorney, Agent, or Firm* — Dean D. Small; The Small Patent Law Group, LLC

(57) ABSTRACT

Radioisotope production system includes an electrical field system and a magnetic field system that are configured to direct a particle beam of charged particles along a beam path within an acceleration chamber. The magnetic field system is energized by a drive current to generate a magnetic flux into the acceleration chamber for controlling the particle beam. The radioisotope production system also includes a target system configured to hold a target material and receive the particle beam. The radioisotope production system also includes a monitoring system that is configured to: (a) determine an operating parameter of the radioisotope production system as the particle beam is directed toward the target material and (b) change the drive current, thereby changing the magnetic flux, based on the operating parameter.

11 Claims, 8 Drawing Sheets

(51) Int. Cl.
*H05H 13/00* (2006.01)
*H05H 7/00* (2006.01)

(52) U.S. Cl.
CPC . *H05H 2007/008* (2013.01); *H05H 2277/116* (2013.01)

(56) References Cited

U.S. PATENT DOCUMENTS

| | | | | |
|---|---|---|---|---|
| 7,577,228 | B2 | 8/2009 | Jackson | |
| 7,786,442 | B2 | 8/2010 | Norling et al. | |
| 8,106,370 | B2 | 1/2012 | Norling | |
| 8,106,570 | B2 | 1/2012 | Norling | |
| 8,153,997 | B2 | 4/2012 | Norling | |
| 8,374,306 | B2 | 2/2013 | Norling | |
| 8,653,762 | B2 | 2/2014 | Eriksson | |
| 9,185,790 | B2 | 11/2015 | Svedberg | |
| 9,763,315 | B2 * | 9/2017 | Stephani | H05H 7/00 |
| 2009/0179599 | A1 | 7/2009 | Bertozzi et al. | |
| 2010/0329406 | A1 | 12/2010 | Norling | |
| 2012/0161671 | A1 | 6/2012 | Eriksson | |
| 2012/0321026 | A1 | 12/2012 | Norling | |
| 2013/0259180 | A1 | 10/2013 | Norling | |
| 2014/0362964 | A1 | 12/2014 | Norling | |
| 2015/0238918 | A1 | 8/2015 | Khachaturian et al. | |
| 2016/0111176 | A1 * | 4/2016 | Nolen, Jr. | G21G 1/10 376/194 |

OTHER PUBLICATIONS

Strijckmans; The isochronous cyclotron: principles and recent developments; Institute for Nuclear Sciences; Ghent University; Computerized Medical Imaging and Graphics 25 (2001); 10 pages.
Hartwig; The AEG compact cyclotron; Proceedings of the Fifth International Cyclotron Conference; 9 pages.
Papash; Commercial Cyclotrons. Part I: Commercial Cyclotrons in the Energy Range 10-30MeV for Isotope Production; Physics of Particles and Nuclei. 2008. vol. 39, No. 4. pp. 597-631.
International Search Report and Written Opinion for corresponding PCT application No. PCT/US2016/048624 dated Jan. 19, 2017; 13 pages.

* cited by examiner

RADIOISOTOPE PRODUCTION SYSTEM AND METHOD FOR CONTROLLING THE SAME

BACKGROUND

The subject matter herein relates generally to radioisotope production systems and, more specifically, to controlling beam properties of a particle beam during radioisotope production.

Radioisotopes (also called radionuclides) have several applications in medical therapy, imaging, and research, as well as other applications that are not medically related. Systems that produce radioisotopes typically include a particle accelerator, such as a cyclotron, that accelerates a beam of charged particles. The charged particles may be H-ions, although positive ions may also be used. The system directs the particle beam such that the charged particles collide with a target material to generate the radioisotopes. The cyclotron includes an ion source that provides ions into an acceleration chamber of the cyclotron. The cyclotron uses an electrical field and a magnetic field (or flux) to accelerate and guide the charged particles along an orbit within the acceleration chamber. The magnetic field may be generated by an electromagnet and a magnet yoke that surrounds the acceleration chamber. A majority of the orbit of the particle beam typically exists between two poles of the magnet yoke.

The electrical fields are generated by one or more radio frequency (RF) electrodes (or dees) that are located within the acceleration chamber. The RF electrodes are electrically coupled to an RF power generator that energizes the RF electrodes to provide the electrical field. The electrical and magnetic fields cause the charged particles to take a spiral-like orbit that has an increasing radius. When the charged particles reach an outer portion of the orbit, the charged particles are directed toward the target material for isotope production.

The electromagnet is controlled by a drive current. During operation of the cyclotron, the magnetic field generated by the electromagnet and the magnetic yoke is weakened as the magnetic material (e.g., steel in the magnetic yoke) is heated. Conventional systems may increase the drive current in accordance with a predetermined algorithm to maintain a suitable magnetic field for controlling the particle beam. The algorithm may be based on historical data from prior sessions. For example, the algorithm may require that the drive current be increased by a fixed amount after ten minutes of operation (or other predetermined time). Although these algorithms can be effective, the isotope production of the conventional system may become less efficient as the session continues.

BRIEF DESCRIPTION

In an embodiment, a radioisotope production system is provided that includes an electrical field system and a magnetic field system that are configured to direct a particle beam of charged particles along a beam path within an acceleration chamber. The magnetic field system is energized by a drive current to generate a magnetic flux into the acceleration chamber for controlling the particle beam. The radioisotope production system also includes a target system configured to hold a target material and receive the particle beam. The radioisotope production system also includes a monitoring system that, for a plurality of times during a production session of the radioisotope production system, is configured to: (a) determine an operating parameter of the radioisotope production system as the particle beam is directed toward the target material and (b) change the drive current, thereby changing the magnetic flux, based on the operating parameter. Optionally, the operating parameter is determined at different values of the drive current.

In some aspects of the embodiment, the operating parameter may include at least one of a beam current that is detected at a designated location along the beam path, a beam profile of the particle beam, a beam quality factor, or a drive current of an ion source system.

In some aspects, the operating parameter may be a plurality of operating parameters. Each of the plurality of operating parameters may be determined at the different values of the drive current. The monitoring system may change the drive current based on the plurality of operating parameters.

Optionally, the operating parameters may be beam parameters of the particle beam that correspond to different locations along the beam path. Optionally, the plurality of operating parameters may include a target current of the particle beam at the target system and a collimator current of the particle beam at a collimator. Optionally, the target system may be configured to hold two separate target materials and the particle beam may be directed toward each of the target materials. The plurality of operating parameters may include a target current associated with each of the target materials.

In some aspects, the monitoring system may determine a beam quality factor based on the operating parameter. Optionally, the radioisotope production system also includes an ion source system that has an operating parameter that is indicative of an output of an ion source. The beam quality factor may be a function of the operating parameter of the ion source and a function of a beam current that is detected at a designated location along the beam path. Optionally the monitoring system may repeatedly: (a) increases the drive current until the beam quality factor worsens and then (b) decreases the drive current until the beam quality factor worsens.

In some aspects, the monitoring system may repeatedly: (a) change the drive current by increasing the drive current or decreasing the drive current until the beam quality factor worsens and then (b)(1) change the drive current in an opposite direction until the beam quality factor worsens or (b)(2) select a new drive current based on a value of the drive current when the beam quality factor worsened.

In some aspects, the monitoring system may obtain data of the operating parameter at one or more drive currents. The monitoring system may analyze the data to identify a new drive current. The monitoring system may change the drive current to the new drive current.

In some aspects, the monitoring system may obtain a plurality of data sets of the operating parameter. Each of the data sets may be obtained at a different drive current, wherein the monitoring system may analyze the data sets to identify a new drive current. The monitoring system may change the drive current to the new drive current. Optionally, the operation of obtaining the plurality of data sets may include sweeping the drive current back-and-forth within a designated range. Optionally, each of the data sets may include a first operating parameter and a second operating parameter for a designated drive current. The monitoring system may select a first sub-group of the data sets based on the first operating parameters and selecting a second sub-group of the data sets from the first sub-group based on the second operating parameters. The new drive current may be based on the designated drive currents of the data sets in the second sub-group.

In an embodiment, method is provided that includes directing a particle beam of charged particles toward a target material using an electrical field system and a magnetic field system. The magnetic field system includes a magnet yoke and an electromagnet that is energized by a drive current to generate a magnetic flux that controls the particle beam. The method may also include monitoring an operating parameter of the particle beam as the particle beam is directed toward the target material. The method also includes changing the drive current, thereby changing the magnetic flux, based on the operating parameter determined at the different values of the drive current. Optionally, the operating parameter is determined at different values of the drive current while monitoring.

In one aspect of the embodiment, the operating parameter may include at least one of a beam current that is detected at a designated location along the beam path, a beam profile of the particle beam, a beam quality factor, or a drive current of an ion source system.

In another aspect, the operating parameter may be a plurality of operating parameters. Each of the plurality of operating parameters may be determined at the different values of the drive current. The drive current may be changed based on the plurality of operating parameters. Optionally, the operating parameters may be beam parameters that correspond to different locations along the beam path of the particle beam. Optionally, the plurality of operating parameters may include a target current of the particle beam at the target system and a collimator current of the particle beam at a collimator. Optionally, the particle beam may be directed toward two separate target materials. The plurality of operating parameters may include a target current associated with each of the target materials.

In another aspect, the method may include determining a beam quality factor based on the operating parameter.

In another aspect, the method may include obtaining a plurality of data sets of the operating parameter. Each of the data sets may be obtained at a different drive current. The method may also include analyzing the data sets to identify a new drive current, wherein the step of changing the drive current includes changing the drive current to the new drive current.

In an embodiment, a radioisotope production system is provided that includes an electrical field system and a magnetic field system that are configured to direct a particle beam of charged particles along a beam path within an acceleration chamber. The magnetic field system is energized by a drive current to generate a magnetic flux into the acceleration chamber for controlling the particle beam. The radioisotope production system also includes a target system configured to hold a target material and receive the particle beam. The radioisotope production system also includes a monitoring system that, for a plurality of times during a production session of the radioisotope production system, is configured to: (a) determine an operating parameter of the radioisotope production system as the particle beam is directed toward the target material and (b) change the drive current, thereby changing the magnetic flux, based on the operating parameter. For example, the drive current may be changed in response to the operating parameter passing a designated limit.

In one aspect, the operating parameter is a beam quality factor. The designated limit may be associated with a lower beam quality such that the beam quality is worsening as the beam quality factor passes the designated limit. After changing the beam current, the system may continue monitoring the beam quality factor. Optionally, the drive current may be changed until the operating parameter passes another designated limit (e.g., upper limit) or until the operating parameter stops improving.

In an embodiment, method is provided that includes directing a particle beam of charged particles toward a target material using an electrical field system and a magnetic field system. The magnetic field system includes a magnet yoke and an electromagnet that is energized by a drive current to generate a magnetic flux that controls the particle beam. The method may also include monitoring an operating parameter of the particle beam as the particle beam is directed toward the target material. The method also includes changing the drive current, thereby changing the magnetic flux, based on the operating parameter. For example, the drive current may be changed in response to the operating parameter passing a designated limit.

DETAILED DESCRIPTION

Figure 1:
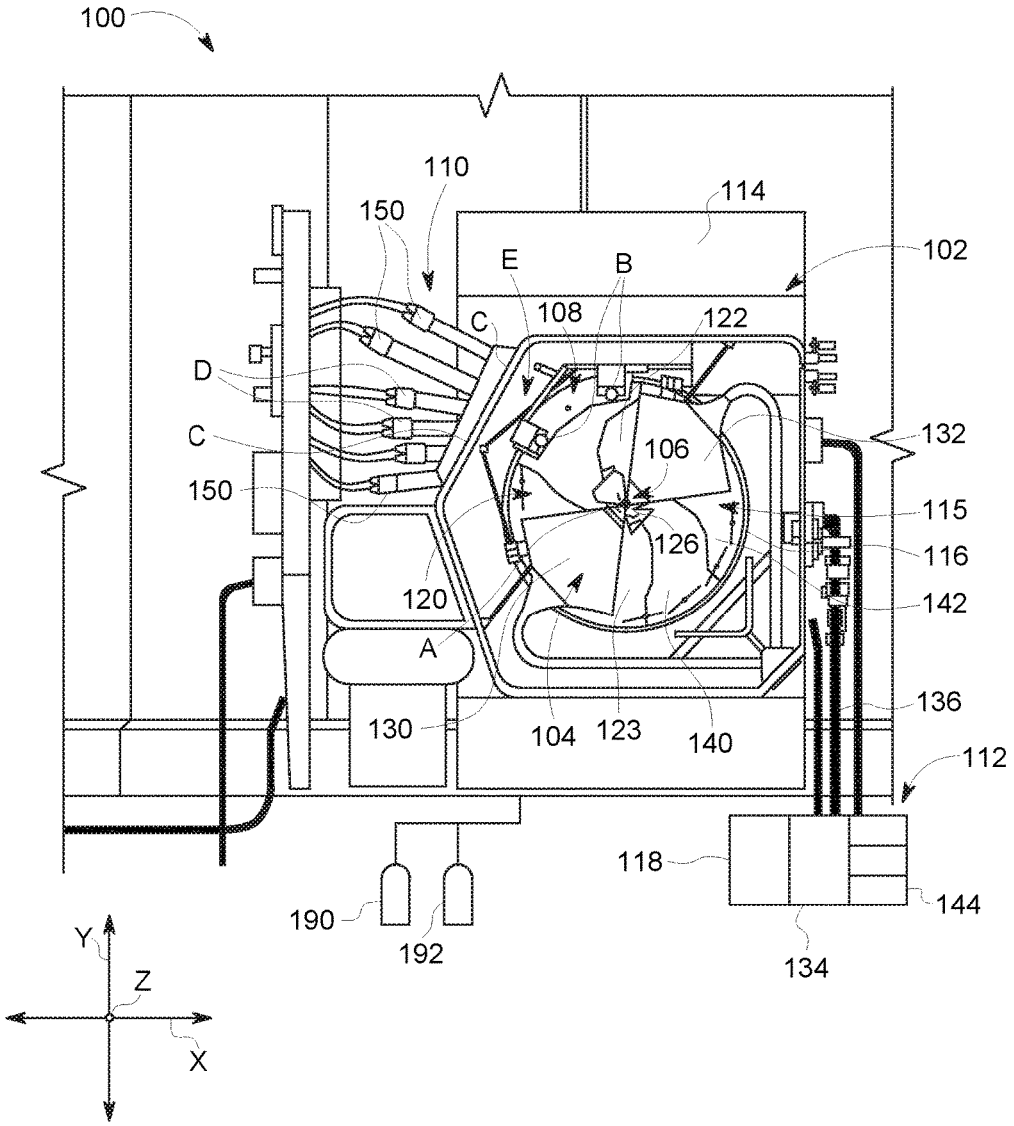
FIG. 1 is a side view of a radioisotope production system in accordance with one embodiment.

Embodiments set forth herein include radioisotope production systems, sub-systems of the same, and methods of controlling the same. Embodiments are configured to monitor an operating parameter during a production session in which a particle beam is incident on a target material to generate radioisotopes. The operating parameter may be a function of a drive current of a magnetic field system (also called magnet current). Embodiments may intentionally change the drive current during the production session and monitor how the change in the drive current affects the operating parameter. The change may be done without knowledge of how the drive current will affect the system.

For example, the change could increase a rate of radioisotope production or decrease a rate of radioisotope production.

In particular embodiments, a number of operating parameters are monitored. Embodiments may analyze the operating parameters and change the drive current based on the analysis. For example, embodiments may continuously monitor a beam quality factor to determine when the beam quality factor is no longer sufficient. The beam quality factor is typically based on a plurality of separate operating parameters. Upon determining that the beam quality factor is insufficient, embodiments may change the drive current. As another example, embodiments receive a single data point or data set or may collect a plurality of data sets of the operating parameters from a range of drive currents. The term "data" includes only a single value or data point or multiple data points, including multiple data sets. The data may be analyzed to identify a new drive current. The operating parameters may be weighted in the analysis.

A technical effect of one or more embodiments is a more efficient production of radioisotopes. Moreover, employing embodiments set forth herein may increase the lifetime operation of an ion source system. A more efficient usage of the system may also lead to lower levels of radioactivity induced by neutral beam losses.

Embodiments set forth herein are configured to produce radioisotopes (also called radionuclides) that may be used in medical imaging, research, and therapy, but also for other applications that are not medically related, such as scientific research or analysis. When used for medical purposes, such as in Nuclear Medicine (NM) imaging or Positron Emission Tomography (PET) imaging, the radioisotopes may also be called tracers. By way of example, a radioisotope production system may generate protons to make $^{18}F^{-}$ isotopes in liquid form, $^{11}C$ isotopes as $CO_2$, and $^{13}N$ isotopes as $NH_3$. The target material used to make these isotopes may be enriched $^{18}O$ water, natural $^{14}N_2$ gas, $^{16}O$-water. The radioisotope production system may also generate protons or deuterons in order to produce $^{15}O$ gases (oxygen, carbon dioxide, and carbon monoxide) and $^{15}O$ labeled water.

The following detailed description of certain embodiments will be better understood when read in conjunction with the appended drawings. To the extent that the figures illustrate diagrams of the functional blocks of various embodiments, the functional blocks are not necessarily indicative of the division between hardware circuitry. For example, one or more of the functional blocks (e.g., processors, memories) may be implemented in a single piece of hardware (e.g., a general purpose signal processor or a block of random access memory, hard disk, or the like) or multiple pieces of hardware. Similarly, the programs may be stand alone programs, may be incorporated as subroutines in an operating system, may be functions in an installed software package, and the like. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

FIG. 1 is a side view of a radioisotope production system 100 in accordance with one embodiment. The radioisotope production system 100 may be referred to as an accelerator or cyclotron in some embodiments. In the illustrated embodiment, the radioisotope production system 100 is a compact isochronous sector focused cyclotron. It should be understood, however, that embodiments may be suitable for other cyclotron configurations or other radioisotope production systems. The radioisotope production system 100 is configured to form a particle beam from charged particles and direct the particle beam along an orbit or beam path. The accelerated particles may include, for example, H- or D-ions, which may be transformed to protons and deuterons, respectively, through an extraction process. In some embodiments, the radioisotope production system 100 may be configured to operate with H-ions in a first mode and D-ions in a second mode. In other embodiments, the radioisotope production system may form a particle beam with positively-charged particles.

The radioisotope production system 100 includes a plurality of sub-systems, which may be referred to simply as systems or assemblies. The systems of the radioisotope production system 100 include a magnetic field system 102, an electrical field system 104 (e.g., radio-frequency (RF) system), an ion source system 106, an extraction system 108, and a target system 110. It should be understood that the above list of sub-systems is not intended to be limiting and that embodiments may include fewer or additional sub-systems. Moreover, one or more sub-systems may share components and/or one or more sub-systems may perform functions that other sub-systems are described herein as performing. The radioisotope production system 100 also includes a control system 112 for controlling operation of the various sub-systems.

The magnetic field system 102 generates a magnetic flux (or magnetic field) that directs the charged particles along a beam path. The beam path in the illustrated embodiment is a spiral-like orbit that cycles around a central axis 126. The magnetic field system 102 includes a magnet yoke 114, an electromagnet or coils 116, and a magnet power supply (MPS) 118. The MPS 118 may be considered a portion of the control system 112. In FIG. 1, only an open-sided section 115 of the magnet yoke 114 is illustrated. Another section (not shown) may be positioned side-by-side with the section 115 to enclose an acceleration chamber 120 where the charged particles are directed along the beam path. The magnet yoke 114 may comprise, for example, a large body of industrial steel. The magnet yoke 114 may form magnet poles 122 that comprise, for example, a high quality steel having a low carbon content. The magnet poles 122 include pole tops 123 that may be plated with a thin layer of copper for providing conductance for eddy currents generated along the pole surface. In FIG. 1, the magnet yoke 114 is oriented such that a mid-plane is vertical and extends parallel to X and Y axes. In some embodiments, the pole tops 123 include hills 140 and valleys 142 such that a pole gap between the opposing pole tops 123 varies. When the yoke sections oppose each other and are closed for operation, the pole tops 123 are separated by an inner spatial region where the charged particles are directed along the particle orbit.

Figure 11:
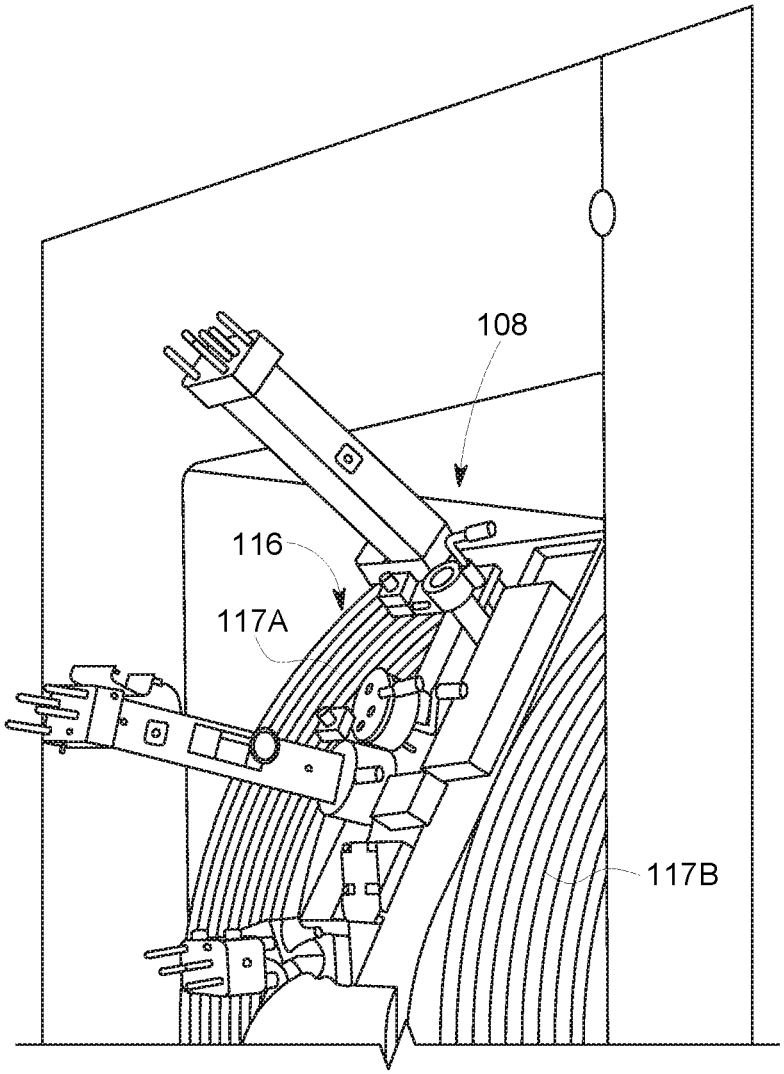
FIG. 11 is a perspective view of the radioisotope production system of FIG. 1 in a closed position.

Only an outer portion of the electromagnet 116 is shown in FIG. 1. The electromagnet 116 is also shown in FIG. 11 and includes a pair of coils 117A, 117B. FIG. 11 is a perspective view of one side of the radioisotope production system 100 that includes the extraction system 108. The coils 117A, 117B having a number of turns about the central axis 126 (FIG. 1). Returning to FIG. 1, the MPS 118 may be a constant current power supply. By way of example, the MPS 118 may supply up to 500 A or more of current to the coils 117A, 117B. This current is hereinafter referred to as a drive current or a magnet current. A strength of the magnetic flux within the acceleration chamber 120 increases as the drive current increases. The strength of the magnetic flux decreases, however, as the magnetic yoke 114 and, particularly, the poles 122 increase in temperature. The changing magnetic flux may alter a beam quality of the particle beam. Embodiments set forth herein are configured to control the drive current to control the beam quality for a desired production of radioisotopes and/or performance of the particle beam. The MPS 118 may include, for example, a transformer, a thyristor bridge, an LC filter, a DC current transformer, and control circuits. Although specific examples are given above, it should be understood that the magnetic field system 102 may operate with different parameters and/or with different components.

The electrical field system 104 is configured to produce an acceleration voltage that oscillates at a high frequency (e.g., RF). In the illustrated embodiment, the electrical field system 104 is configured to accelerate the particle beam within the acceleration chamber 120 by providing the charged particles four energy steps per revolution. The electrical field system 104 may also be configured to draw ions from the ion source system 106. The electrical field system 104 includes a resonator system formed by two electrodes (or dees) 130, 132 that are positioned within the acceleration chamber 120. The electrodes 130, 132 form respective quarter-wave lines and are inductively coupled to each other. However, it is understood that there may be other types of coupling between dees and more or less than four energy steps per revolution based on the number of dees.

The electrical field system 104 also includes a power generator 134 (or RFPG) and a feeder cable 136 that transmits RF power from the power generator 134 to the electrodes 130, 132. The power generator 134 generates an RF signal and may also amplify the RF signal to a power level necessary to support losses of the electrical field system 104. Although specific examples are given above, it should be understood that the electrical field system 104 may operate with different power parameters and/or with different components. The magnetic field system 102 and the electrical field system 104 are controlled by the control system 112 as described herein.

During operation of the radioisotope production system 100, charged particles are provided into the acceleration chamber 120 through the ion source system 106. The ion source system 106 may include one or more sources of gas. For example, the ion source system 106 may include a first source 190 having a first gas (e.g., hydrogen gas $H_2$) and a second source 192 having a second gas (e.g., deuterium gas $D_2$). The ions may be supplied through an opening or slit 194 (shown in FIG. 3) that is located at the midplane and proximate to the central axis 126. The slit 194 may represent the starting point of the particle beam. By way of example, the ions may be supplied by forming a plasma between two opposite cathodes (not shown) that are positioned in line with the magnetic flux of the magnetic field system 102. The cathodes are connected to an ion source power supply 144 that supplies a drive current (or ion source drive current). A concentration of negative ions will appear in the slit 194, and the ions can be extracted from the ion source system 106 by a positive potential, which is provided by the electrodes 130, 132. Ions exit the slit 194 and are accelerated into the orbit guided by the magnetic flux and by the electrical field, which is formed by the electrodes 130, 132. Although the above describes one example of an ion source system, it should be understood that other methods and configurations may be used to provide charged particles to the acceleration chamber 120.

After the charged particles are provided into the acceleration chamber 120, the magnetic field system 102 and the electrical field system 104 are configured to generate respective fields that cooperate in producing a particle beam of the charged particles. The charged particles are accelerated and guided within the acceleration chamber 120 along the beam path that coincides with or extends generally along the midplane.

During operation of the radioisotope production system 100, the acceleration chamber 120 is in a vacuum (or evacuated) state and experiences a large magnetic flux. For example, an average magnetic field strength between pole tops in the acceleration chamber 120 may be at least 1 Tesla. After the particle beam is generated, the pressure of the acceleration chamber 120 may be, for example, approximately $2\times10^{-5}$ millibar. Again, the above values are only examples and various embodiments may operate within different parameters.

To generate radioisotopes, the particle beam is directed by the radioisotope production system 100 through the extraction system 108 along a beam transport path and into the target system 110 so that the particle beam is incident upon target material located at a corresponding target location. In the illustrated embodiment, the target system 110 includes six potential target locations 150, but it should be understood that other embodiments may include a different number of target locations 150, including only one target location. In some embodiments, the radioisotope production system 100 and the extraction system 108 may be configured to direct the particle beam along different paths toward the target locations 150.

As described herein, the radioisotope production system 100 may detect one or more operating parameters at different drive current values during operation (e.g., while the particle beam is directed onto the target material). The operating parameter may be, for example, a beam current, a beam profile, or an ion source drive current. In particular embodiments, multiple operating parameters are detected at multiple path locations. For example, operating parameters may be detected at a beginning point of the beam path (referenced as A in FIG. 1), at extraction points (referenced as B), at collimating points (referenced as C), or at target points (referenced as D). Points A-D may also be referred to generally as detection points. It should be understood that, depending upon the type of radioisotope production system and the operating mode of the radioisotope production system, the detection points A-D may occur at different locations. In the illustrated embodiment, the collimating point C may occur at six different locations (one for each collimator), and the target point D may occur at six different locations (one for each target).

In other embodiments, the operating parameter may be detected at another detection point. For example, a beam profile monitor may be positioned, for example, between the extraction system 108 and the target system 110 (referenced as E).

In particular embodiments, the radioisotope production system 100 brings the charged particles to a designated energy level and creates a designated beam current. For example, the radioisotope production system 100 may bring the charged particles to a designated energy with a beam current of between, for example, 10-200 μA. It should be understood that other beam currents may be possible. As to energy levels, some embodiments described herein may accelerate the charged particles to an energy of approximately 30 MeV or less. For example, the H-ions may be brought an energy of about 17 MeV, and the D-ions may be brought to an energy of about 8.5 MeV. Again, it should be understood that other energies may be achieved in alternative embodiments. For example, the radioisotope production system 100 may accelerate the charged particles to an energy of approximately 7.8 MeV or less. However, alternative embodiments may have an energy above 100 MeV, 500 MeV or more.

Figure 2:
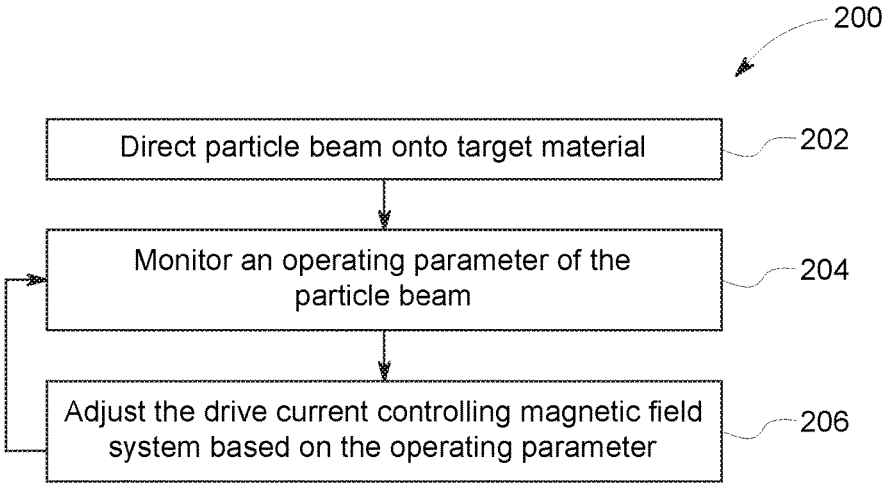
FIG. 2 is a flow chart of a method in accordance with an embodiment that may be performed by the radioisotope production system of FIG. 1.

FIG. 2 is a flow chart of a method 200 in accordance with an embodiment that may be performed by the radioisotope production system 100 of FIG. 1. More detailed aspects of the method 200 are described with respect to the methods 300 and 400 shown in FIGS. 7 and 9, respectively. The methods 200, 300, and 400 may employ structures or aspects of various embodiments (e.g., systems and/or methods) discussed herein. In various embodiments, certain steps of the methods may be omitted or added, certain steps may be combined, certain steps may be performed simultaneously, certain steps may be performed concurrently, certain steps may be split into multiple steps, certain steps may be performed in a different order, or certain steps or series of steps may be re-performed in an iterative fashion.

The method 200 includes directing, at 202, a particle beam of charged particles onto a target material using an electrical field system and a magnetic field system. As described above, the magnetic field system may be energized by a drive current to generate a magnetic flux. The strength of the magnetic flux is a function of the drive current. At 204, an operating parameter of the particle beam may be monitored as the particle beam is directed toward the target material. For example, the operating parameter may be determined as the particle beam is incident upon the target system. The operating parameter may be, for example, a beam current at one or more points along the beam path of the particle beam, such as one or more of the points A, B, C, or D. The operating parameter may be a current that is supplied to an ion source system. This current may be referred to as an ion source drive current. The operating parameter may also be derived from data provided by a beam-profile monitor. The operating parameter may also be a beam quality factor, which may be based on a plurality of operating parameters. For example, the beam quality factor may be based on a beam current detected at one or more points along the beam path and an ion source drive current. The beam quality factor may also be based on data from a beam-profile monitor. The beam quality factor may also be based on a variety of beam parameters, such as intensity, emittance, and modulation.

It should be understood, however, that the operating parameters are not limited to a beam current, an ion source drive current, or data from the beam profile monitor. Instead, any measurable or determinable (e.g., calculable) parameter that may be used to select a new drive current or control a drive current during operation of the radioisotope production system to obtain a desired performance of the radioisotope production system. For example, an operating parameter may be directly or indirectly associated with the strength of the magnetic flux, a quality of the particle beam, and/or an alignment of the beam with respect to the target material. Examples of other operating parameters include (1) a pressure within a target chamber during the production session; (2) a vacuum level or pressure within the acceleration chamber during the production session; and (3) a temperature of the magnet (e.g., pole tops and/or elsewhere) during the production session. Embodiments may use any combination of operating parameters.

The monitoring, at 204, of the operating parameter may include determining only one operating parameter (e.g., beam current at the target location) or may include determining multiple operating parameters (e.g., beam current at the target location, beam current at the extraction system, beam current at the collimator, and drive current at the ion source). In some embodiments, the operating parameters may be determined for multiple values of a drive current. For example, each of the beam currents may be determined at the drive current values of 409 A, 409.5 A, 410 A, 410.5 A, and 411 A. Data sets may include the values of different operating parameters at a single drive current. Alternatively, data sets may include the different values of a single operating parameter that were obtained at multiple drive currents.

At 206, the drive current of the magnetic field system is changed based on the operating parameter(s) determined at the different values of the drive current. The steps of monitoring 204 and/or changing 206 may include analyzing the data to determine a new drive current. The data may be a single data point (e.g., value of operating parameter when drive current is X), a data set having multiple data points, or a plurality of data sets. After changing the present drive current to the new drive current, the method 200 returns to the monitoring operation at 204. When the drive current is changed, the magnetic flux of the magnetic field system changes and the steps of monitoring 204 and changing 206 may be repeated throughout the production session.

In some embodiments, the drive current may be continuously increased (or decreased) until an operating parameter(s) indicates that a desired property (e.g., beam quality factor) has worsened. Upon detecting the worsening property, the drive current may be continuously decreased (or increased) until the property has begun to worsen again at which time the process will repeat. This process may repeat throughout operation of the radioisotope production system 100 such that the drive current is changed a number of times based upon information obtained through monitoring the operating parameter(s). The above example is described in greater detail with respect to FIGS. 6 and 7.

In some embodiments, the system may obtain a single data point at a designated drive current or data set. The system may analyze the data to determine a new drive current. For example, if the present beam current is Y when the drive current is X, the system may determine a difference between the present beam current and an ideal or desired beam current. Based on this difference, the drive current may be changed by a small amount or a larger amount. More specifically, if the difference is small, then the drive current may only be changed by a small amount. If the difference is large, then the drive current may be changed by a larger amount. The direction of change (plus or minus) may be based on whether the beam current is above or below the ideal beam current.

In some embodiments, the system may obtain a plurality of data sets within a range of drive current values and analyze the data sets to select a new drive current. The method 200 may change, at 206, the present drive current to the new drive current. The plurality of data sets may include data from different points along the path of the particle beam after sweeping the drive current back-and-forth within a designated range. More specifically, each of the data sets may include a first operating parameter (e.g., beam current at point B) and a second operating parameter (e.g., beam current at point D). The control system may select a first sub-group of the data sets based on the first operating parameter. For example, the control system may determine that better values of the beam current occurred when the drive current was within a sub-range of the broader range. The control system may then select a second sub-group of the data sets from the first sub-group based on the second operating parameter. More specifically, the control system may examine the beam current detected at point B for the different values within the first sub-group and identify one or more drive currents having desirable values for point B. Further filtering may be done based on other operating parameters. This process may be repeated throughout operation or at designated intervals (e.g., every minute, every 5 minutes, every 10 minutes, every 20 minutes, etc.). The above is described in greater detail with respect to FIGS. 8 and 9.

Figure 3:
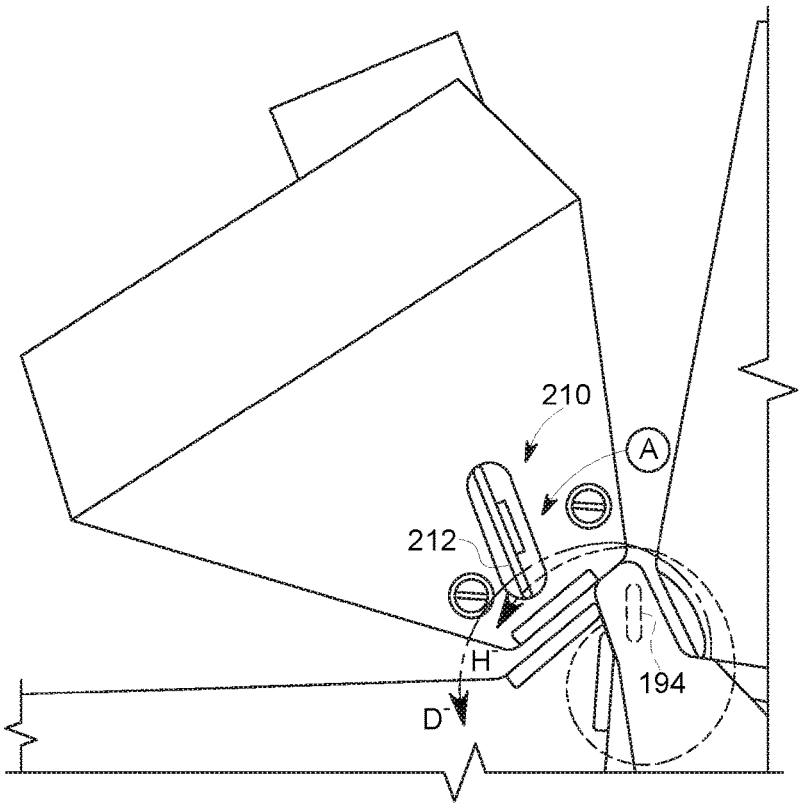
FIG. 3 is a side view of a probe that may be used with the radioisotope production system of FIG. 1.

FIG. 3 is a side view of a probe 210 that may be used with the radioisotope production system 100. The probe 210 is located at position A and may operate as a beam current valve and beam current detector. In a blocking position (shown in FIG. 3), the probe 210 can monitor the beam current of the intercepted charged particles. The probe 210 is positioned proximate to the slit 194 of the ion source system 106, which is covered in FIG. 3, in order to block the beam at a low energy, thereby reducing the likelihood of overheating the probe 210. The probe 210 includes a blocking plate 212 that is configured to block the charged particle. The blocking plate 212 may include, for example, tantalum and/or other material. The probe 210 may be insulated from ground to enable measuring the beam current at point A. The probe 210 may include an actuator mechanism (e.g., coil actuator) (not shown) for moving the blocking plate 212 between a blocking position and an open position. In the open position, the charged particles may continue on the beam path and be directed toward the target system. The beam current data that is obtained by the probe 210 may be used to verify that the ion source system 106 is operating sufficiently.

Figure 4:
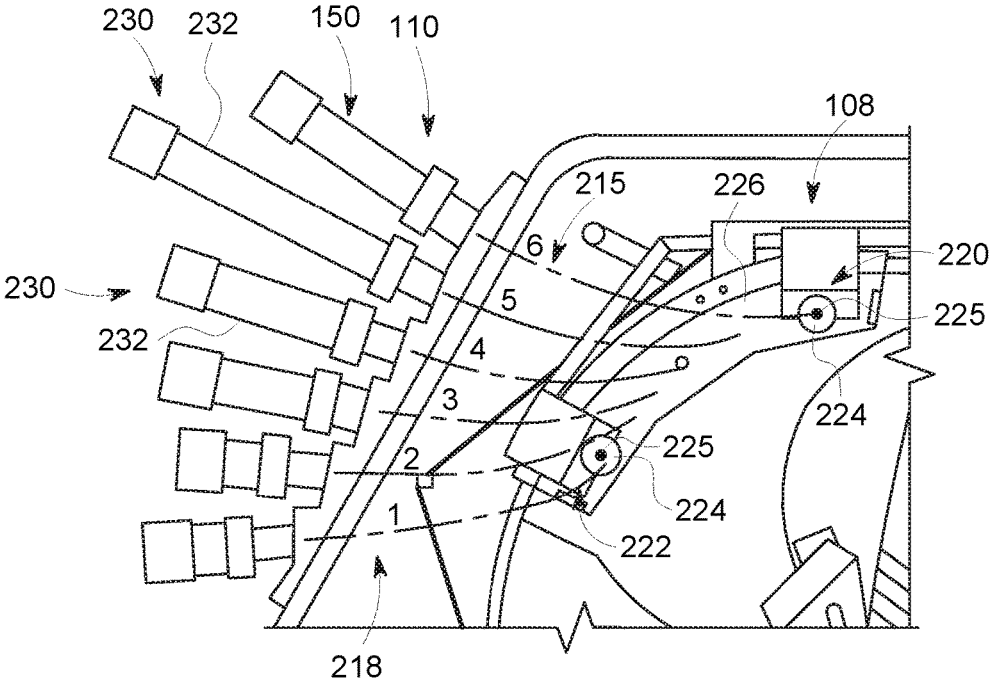
FIG. 4 is a side view of an extraction sub-system and a target sub-system that may be used with the radioisotope production system of FIG. 1.

FIG. 4 is a side view of the extraction system 108 and the target system 110. In the illustrated embodiment, the extraction system 108 includes first and second extraction units 220, 222 that each includes a foil holder 224 and one or more extraction foils (not shown). The extraction process may be based on a stripping-foil principle. More specifically, the electrons of the charged particles (e.g., the accelerated negative ions) are stripped as the charged particles pass through an extraction foil. The charge of the particles is changed from a negative charge to a positive charge thereby changing the trajectory of the particles in the magnet field. The extraction foils may be positioned to control a trajectory of an external particle beam 215 that includes the positively-charged particles and may be used to steer the external particle beam 215 toward designated target locations 150.

In the illustrated embodiment, the foil holders 224 are rotatable carousels that are capable of holding one or more extraction foils. However, the foil holders 224 are not required to be rotatable. The foil holders 224 may be selectively positioned along a track or rail 226. The extraction system 108 may have one or more extraction modes. For example, the extraction system 108 may be configured for single-beam extraction in which only one external particle beam 215 is guided to an exit port 218. In FIG. 4, there are six exit ports 218, which are enumerated as 1-6.

The extraction system 108 may also be configured for dual-beam extraction in which two external beams 215 are guided simultaneously to two exit ports 218. In a dual-beam mode, the extraction system 108 may selectively position the extraction units 220, 222 such that each extraction unit intercepts a portion of the particle beam (e.g., top half and bottom half). The extraction units 220, 222 are configured to move along the track 226 between different positions. For example, a drive motor may be used to selectively position the extraction units 220, 222 along the track 226. Each extraction unit 226 has an operating range that covers one or more of the exit ports 218. For example, the extraction unit 220 may be assigned to the exit ports 4, 5, and 6, and the extraction unit 222 may be assigned to the exit ports 1, 2, and 3. Each extraction unit may be used to direct the particle beam into the assigned exit ports.

The foil holders 224 may be insulated to allow for current measurement of the stripped-off electrons. The extraction foils are located at a radius of the beam path where the beam has reached a final energy. In the illustrated embodiment, each of the foil holders 224 holds a plurality of extraction foils (e.g., six foils) and is rotatable about an axis 225 to enable positioning different extraction foils within the beam path.

The target system 110 includes a plurality of target assemblies 230. A total of six target assemblies 230 are shown and each corresponds to a respective exit port 218. When the particle beam 215 has passed the selected extraction foil, it will pass into the corresponding target assembly 230 through the respective exit port 218. The particle beam enters a target chamber (not shown) of a corresponding target body 232. The target chamber holds the target material (e.g., liquid, gas, or solid material) and the particle beam is incident upon the target material within the target chamber. The particle beam may first be incident upon one or more foils within the target body 232. The target assemblies 230 are electrically insulated to enable detecting a current of the particle beam when incident on the target material, the target body 232, and/or foils within the target body.

Figure 5:
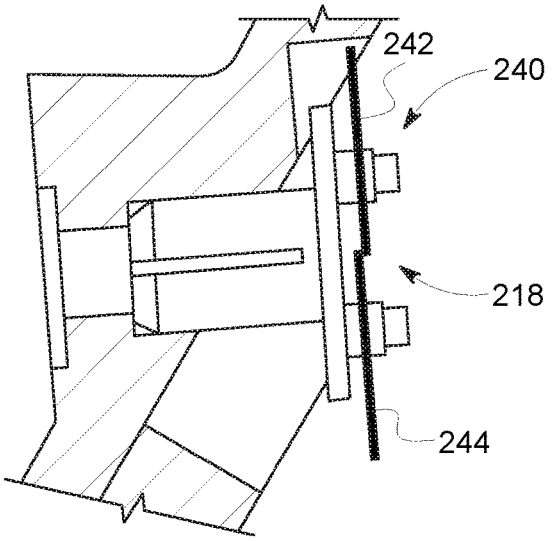
FIG. 5 is a side cross-sectional view of a collimator assembly that may be used with the radioisotope production system of FIG. 1.

FIG. 5 is a side cross-sectional view of an exemplary collimator assembly 240 that may be positioned at a corresponding exit port 218. As shown, the collimator assembly 240 includes two beam collimators 242, 244 that are mounted to the target system 110. Other embodiments may include only one beam collimator or more than two beam collimators. The beam collimators 242, 244 may be referred to as upper and lower beam collimators 242, 244, respectively. In the illustrated embodiment, each of the beam collimators 242, 244 has two functions. First, the beam collimators 242, 244 may define beam boundaries. More specifically, a size of a hole through each of the upper and lower collimators 242, 244 may define a portion of the outer boundary of the particle beam and, consequently, the size of the beam spot that is incident upon foils in the target chamber. Second, the collimators are insulated from ground. The portions of the particle beam that are intercepted by the collimators 242, 244 may be detected and may represent a portion of a total target current. Moreover, a monitoring system 250 (shown in FIG. 6) may measure possible unbalances in the particle beam based on the currents detected by the collimators 242, 244. The monitoring system 250 may then re-position the particle beam accordingly until the measurements obtained by the collimators indicate that the particle beam is sufficiently balanced. For example, the particle beam may be balanced when the collimators detect the same current value.

Figure 6:
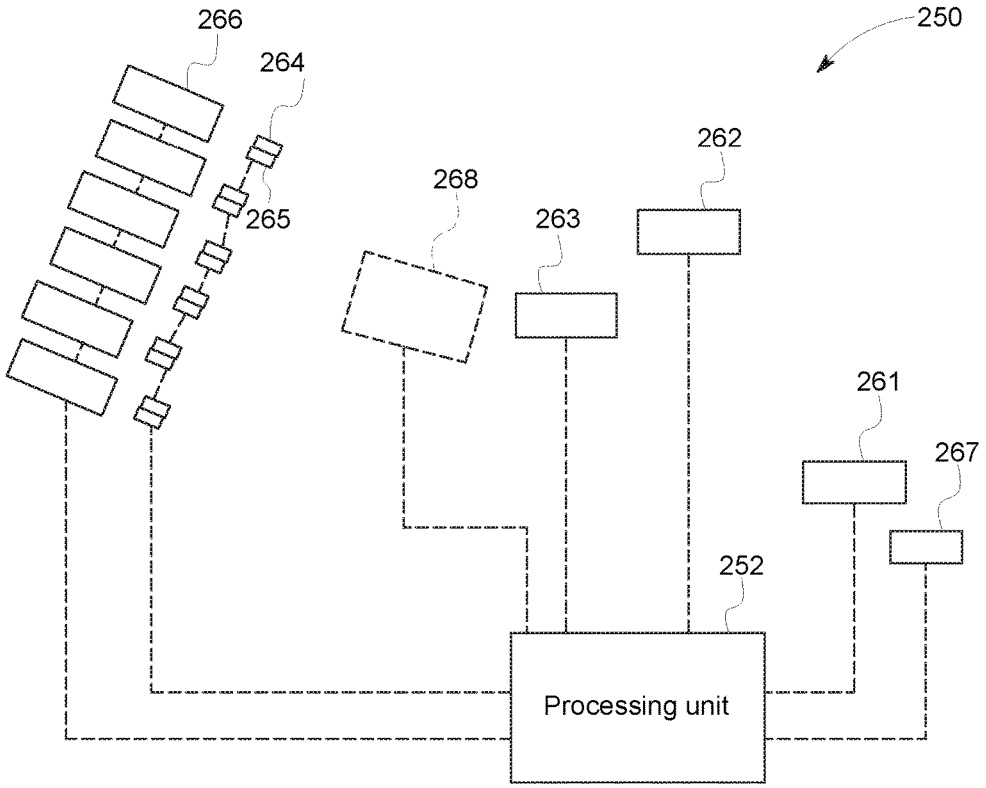
FIG. 6 is a block diagram of a monitoring system that may be used with the radioisotope production system of FIG. 1.

FIG. 6 is a schematic diagram of a monitoring system 250 that may be used with the radioisotope production system 100. The monitoring system 250 may be a portion of the control system 112 (FIG. 1). As shown, the monitoring system 250 includes a processing unit 252. The processing unit 252 is configured to receive data regarding one or more operating parameters from one or more detectors. In the illustrated embodiment, the processing unit 252 may receive a beam current reading from a detector 261 in the probe 210 (illustrated in FIG. 3), one or more beam current readings from detectors 262, 263 of the extraction units 220, 222 (illustrated in FIG. 4), beam current readings from detectors 264, 265 of the collimators 242 or 244 (illustrated in FIG. 5), and a beam current reading from detector 266 of a corresponding target body 232 (illustrated in FIG. 4). Optionally, a supply current of the ion power supply 144 may be detected by a detector 267 of the ion power supply 144. The detectors 261-266 may be, for example, current-to-voltage converters that are each operably coupled to a conductive surface that receives current from the particle beam.

Alternatively or in addition to one or more of the above beam current readings, the processing unit 252 may receive a beam profile reading from a beam profile monitor 268. A beam profile describes a relative beam distribution over a designated cross-sectional area of the beam. The designated area may be, for example, within the target system, proximate to the target system, or immediately after the extraction system. The beam profile may include one or more wires or electrodes that have the particle beam incident thereon. Some beam profile monitors include an array or mesh of wires that is positioned to intercept the particle beam.

The readings may be referred to more specifically in the description and claims. For example, a beam current reading from the detector 261 of the probe 210 may be referred to as a probe current. The beam current reading from the extraction system 108 may be referred to as an extraction current (or foil current). The beam current reading from the collimators 242, 244 may be referred to as a collimator current, and the beam current reading from the target body 232 may be referred to as a target current. The monitoring system 250 is configured to analyze the readings to determine a quality or status of the particle beam. As described herein, the monitoring system 250 may also analyze the readings to determine a desired drive current for the magnetic field system 102.

As used herein, a "processing unit" includes processing circuitry configured to perform one or more tasks, functions, or steps, such as those described herein. For instance, the processing unit may be a logic-based device that performs operations based on instructions stored on a tangible and non-transitory computer readable medium, such as memory. The processing unit may also be a hard-wired device (e.g., electronic circuitry) that performs the operations based on hard-wired logic that is configured to perform the algorithms and/or methods described herein. The processing unit may include one or more ASICs and/or FPGAs. It may be noted that "processing unit," as used herein, is not intended to necessarily be limited to a single processor or a single hard-wired device. For example, the processing unit may include a single processor (e.g., having one or more cores), multiple discrete processors, one or more application specific integrated circuits (ASICs), and/or one or more field programmable gate arrays (FPGAs). In some embodiments, the processing unit is an off-the-shelf device that is appropriately programmed or instructed to perform operations, such as the algorithms described herein.

It is noted that operations performed by the processing unit (e.g., operations corresponding to the methods/algorithms described herein, or aspects thereof) may be sufficiently complex that the operations may not be performed by a human being within a reasonable time period based on the intended application of the radioisotope production system. The processing unit may be configured to receive signals (e.g., data or information) from the various sub-systems. The processing unit may also be configured to perform one or more steps of the methods set forth herein.

Processing units may also include or be communicatively coupled to memory. In some embodiments, the memory may include non-volatile memory. For example, the memory may be or include read-only memory (ROM), random-access memory (RAM), electrically erasable programmable read-only memory (EEPROM), flash memory, and the like. The memory may be configured to store data regarding various parameters of the system.

Figure 7:
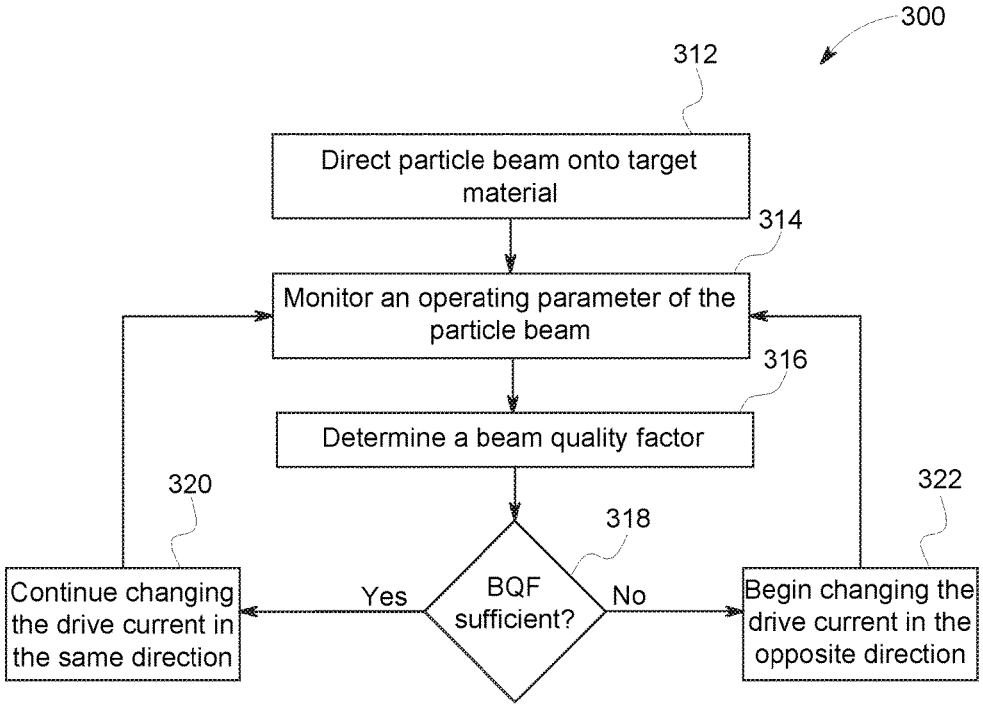
FIG. 7 is a flow chart of a method in accordance with an embodiment that may be performed by the radioisotope production system of FIG. 1.
Figure 8:
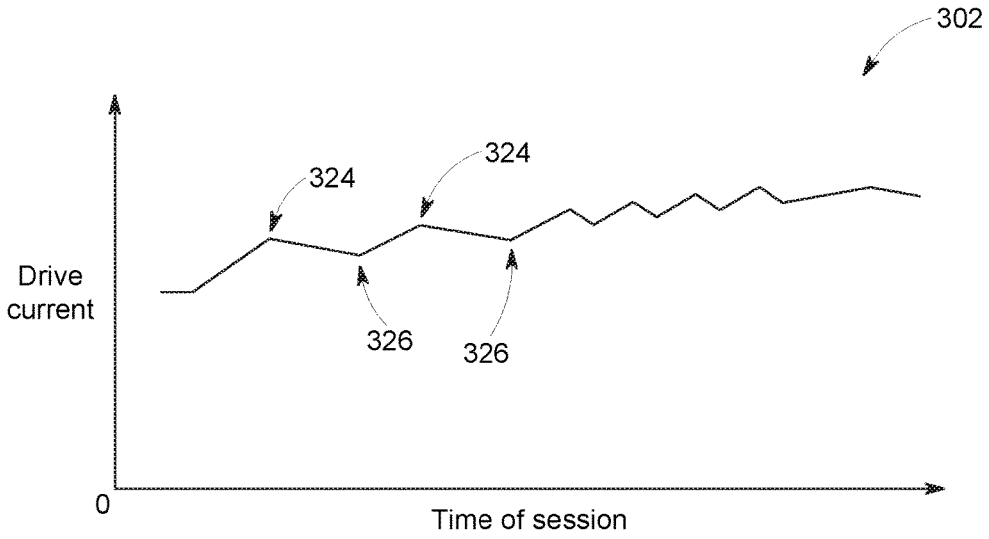
FIG. 8 is a graph illustrating the method of FIG. 6 throughout a production session of the radioisotope production system.

FIG. 7 is a flow chart of a method 300 in accordance with an embodiment that may be performed by the radioisotope production system 100 (FIG. 1), and FIG. 8 is a graph 302 illustrating how the method 300 may control the drive current of the magnetic field system. The method 300 may include steps or operations that are similar or identical to the steps and operations of the method 200 (FIG. 2). For example, the method 300 includes directing, at 312, a particle beam of charged particles onto a target material using an electrical field system and a magnetic field system. At 314, the method 300 includes monitoring an operating parameter of the particle beam as the particle beam is directed toward the target material. During monitoring, at 314, the drive current may be changed in a predetermined manner. For example, the drive current may increase or decrease at a designated rate.

As described herein, monitoring an operating parameter may include monitoring multiple operating parameters. For example, a first operating parameter may be a beam current detected at the target bodies. A second operating parameter may be a beam current detected one of the collimators, and a third operating parameter may be the beam current at the other collimator. A fourth operating parameter may be a drive current of an ion source system (or ion source drive current).

At 316, the method 300 may include determining a beam quality factor. The beam quality factor represents a status of the particle beam relative to a desired particle beam or desired qualities of the particle beam. For example, during operation, the particle beam may become misaligned, a profile of the particle beam may become misshaped, or an intensity of the particle beam may decrease. As the particle beam becomes more misaligned, more misshaped, or decrease in intensity, the beam quality factor decreases. As the particle beam becomes better aligned better shaped, the beam quality factor may increase.

The beam quality factor may be calculated using readings obtained by the monitoring system 250. For example, in some embodiments, the beam quality factor (BQF) may be calculated using the formula:

$$BQF = \frac{(I_T - I_{C1} - I_{C2})}{I_{IS}}$$

wherein $I_T$ may be a target current; $I_{C1}$ may be a collimator current; $I_{C2}$ may be another collimator current; and $I_{IS}$ may be a drive current of the ion source system. The drive current of the ion source system is indicative of an output of the ion source system. It is noted that the above formula is just one example and that the formula may be modified or another formula may be used based upon the application of the system. For example, during two-beam extraction the formula may be a function of two pairs of collimator currents and the two target currents.

At 318, the method 300 may query whether the beam quality factor is sufficient. For example, a predetermined BQF threshold or baseline may be established and the beam quality factor may be compared to the BQF threshold. If the beam quality factor is sufficient, the method 300 continues changing the drive current in the present direction (e.g., increasing or decreasing) at 320 and returns to monitoring the operating parameters at 314 and determining a beam quality factor at 316. Alternatively or in addition to comparing the BQF to the threshold, the query at 318 may determine that the BQF is sufficient by determining whether the BQF has improved or worsened. For example, if the present BQF has improved compared to the prior BQF (e.g., the BQF obtained at a different drive current), then the present BQF is sufficient. If the present BQF has worsened compared to the prior BQF, then the present BQF is not sufficient. Such determinations may be made without knowing or having a BQF threshold.

If the beam quality factor is not sufficient, a new drive current may be selected at 322 and the method may return to monitoring the operating parameters at 314 and determining a beam quality factor at 316. For example, the method 300 may gradually change, at 322, the drive current in the opposite direction.

In some embodiments, the drive current may be changed continuously (e.g., every ten seconds or less) or changed at predetermined intervals (e.g., every ten minutes). The change may be relatively small such that the change in the current over an extended period of time is gradual. The gradual change may increase or decrease the drive current. For example, the drive current may be changed at a rate of 0.1 A per second (or −0.1 A per second). The beam quality factor is repeatedly determined (e.g., calculated) as the drive current changes at 316. In some embodiments, when the drive current becomes insufficient, the drive current may then be changed in the opposite direction. For example, the drive current may be gradually increased until the beam quality factor is insufficient. When it is determined that the beam quality factor is insufficient, the drive current may then be gradually decreased. Again, the beam quality factor is repeatedly calculated as the drive current is gradually decreased. When it is determined that the beam quality factor is insufficient, the drive current may then be gradually increased. This process may repeat until the end of the production session, for a designated period of time, or until a designated event occurs.

In other embodiments, a new drive current may be selected based on a value of the drive current when the BQF worsened and/or based on the range of values in which the BQF improved prior to worsening. For example, if the BQF worsened at 430 A after the BQF improved from 426 A to 430 A, the new drive current may be selected to be within the range of values in which the BQF improved. For instance, the new drive current may be selected to be 428 A.

In some embodiments, the new drive current may be selected to achieve a predetermined value of the BQF. For example, if the BQF improved from 8-10 and then worsened, the new drive current may be selected to achieve a BQF of at least 9. The selection process may include analyzing the prior drive current values and associated BQF values to determine the drive current value when the BQF was at a desired value.

As shown in the graph 302 of FIG. 8, the drive current is changing throughout a production session. Each of these rate-change events is designated at 324 and 326. Each change in the rate from increasing-to-decreasing (referenced at 324) or decreasing-to-increasing (referenced at 326) is triggered by identifying that the beam quality factor is insufficient and, consequently, the drive current should be changed in a different manner. It should be understand that the graph 302 is illustrative only and that the rate-change events 324, 326 may occur fewer times or more times than shown in the graph 302.

In other embodiments, the method 300 may be configured to monitor the BQF and change the drive current in order to maintain the BQF between two thresholds or limits (upper limit and bottom limit). In the following example, the upper limit represents a better beam quality and the lower limit represents a worse (although acceptable) beam quality. More specifically, the BQF may be monitored and determined at 314 and 316, respectively, over an unknown period of time without repeatedly or continuously changing the drive current. During this period of time, the BQF may change during operation. For example, the BQF may increase or decrease (e.g., fluctuate) within the upper and lower limits. If it is determined, at 318, that the BQF has passed a designated threshold (e.g., fell below a lower limit), the drive current may then be changed to a different value. For instance, the drive current may be incrementally changed until the BQF obtains a designated value (e.g., upper limit) or until the BQF stops increasing. Once the BQF obtains the upper limit or the BQF stops increasing (e.g., stops moving toward the upper limit), the method may return to monitoring the BQF. The drive current may also be changed by a more substantial amount. For example, instead of incrementally changing the drive current by 0.1 A, the method may change the drive current one time by at least 1.0 A, at least 2.0 A, or more. After changing the drive current by a substantial amount, the method may return to monitoring the BQF until the BQF passes a designated threshold.

As one specific example, the method may monitor the BQF. Over a period of two minutes, the BQF may fluctuate and gradually decrease from 10 to 9. When the BQF falls below 9, the method may make a single change to the drive current from 410 A to 412 A, which may cause the BQF to move to 9.8. Alternatively, the method may repeatedly change the drive current until the BQF reaches a designated value (e.g., 10) or until the BQF stops increasing. For example, the drive current may be increased in increments of 0.1 A until the BQF obtains the designated value or until the BQF does not increase. The method may then return to monitoring and determining the BQF until the BQF passes the same (or different) lower limit, at which time the method may change the drive current again. Thus, in the above example, the method makes intermittent changes to the drive current based on when the BQF passes a limit (e.g., lower limit).

Although the above example was described with respect to monitoring the BQF, it should be understood that one or more other operating parameters may be monitored instead. For example, a beam current at the extraction system may be monitored. When the beam current exceeds an upper limit or falls below a lower limit, the drive current may be changed. The beam current may then be monitored again until the beam exceeds the upper limit or falls below the lower limit.

Figure 9:
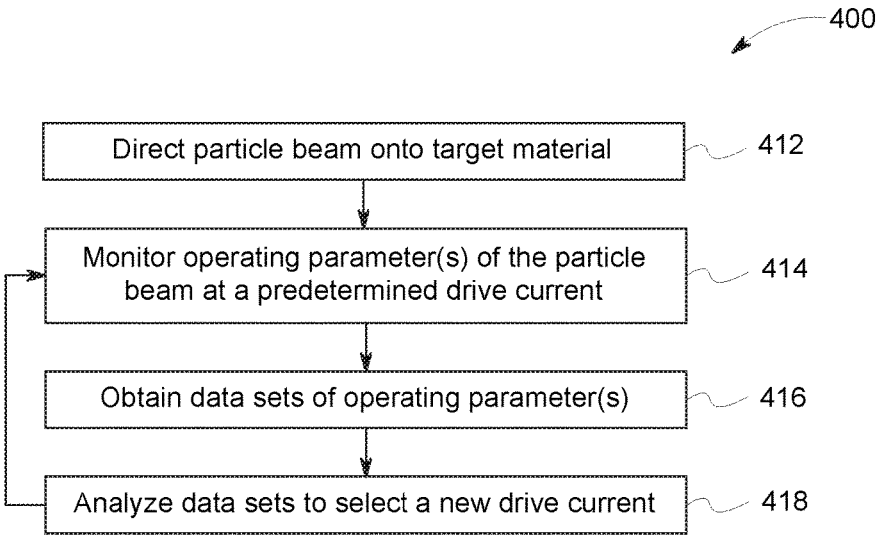
FIG. 9 is a flow chart of a method in accordance with an embodiment that may be performed by the radioisotope production system of FIG. 1.
Figure 10:
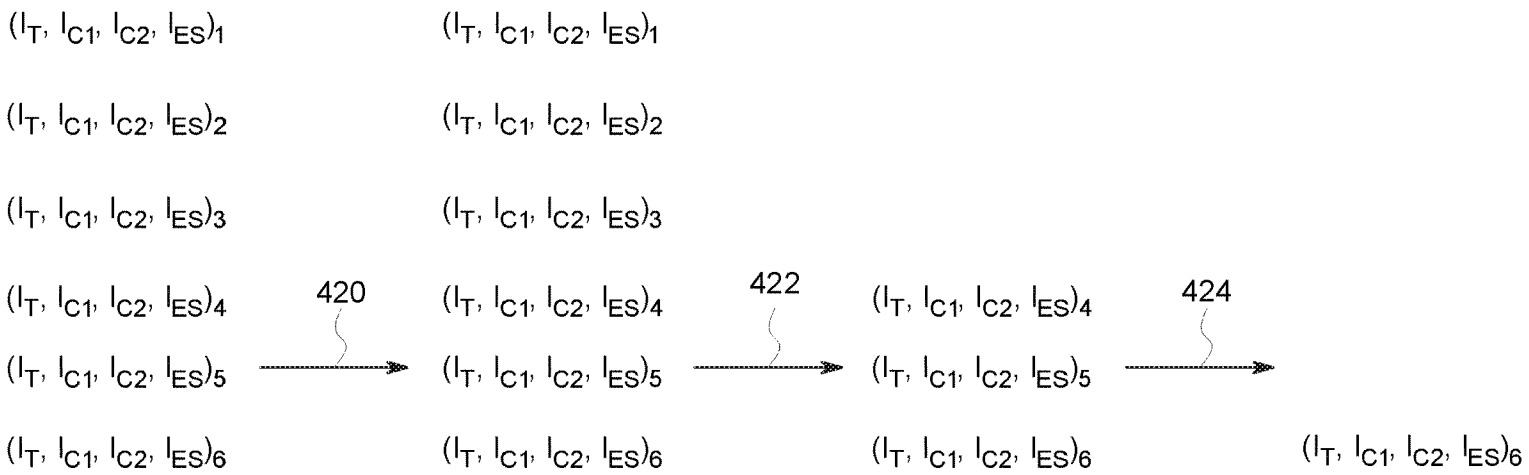
FIG. 10 is a graph illustrating the method of FIG. 8 throughout a production session of the radioisotope production system.

FIG. 9 is a flow chart of a method 400 in accordance with an embodiment that may be performed by the radioisotope production system 100 (FIG. 1), and FIG. 10 illustrates the method 400 in greater detail. The method 400 may include steps or operations that are similar or identical to the steps and operations of the method 200 (FIG. 2) or the method 300

(FIG. 7). For example, the method 400 includes directing, at 412, a particle beam of charged particles onto a target material using an electrical field system and a magnetic field system. At 414, the method 300 includes monitoring one or more operating parameters of the particle beam as the particle beam is directed toward the target material. The monitoring at 414 may be conducted when the drive current has a predetermined and set (static) value.

During monitoring at 414, a plurality of data sets may be obtained at 416. For example, a first data set may be obtained at a first drive current value, a second data set may be obtained at a different second drive current, a third data set may be obtained at a different third drive current, and so on. Each data set may include a plurality of values for one or more operating parameters. As one particular example, values of the beam current may be obtained for the first drive current value at the extraction system, the target body, and the collimators. In this example, the first data set includes $I_T$, $I_{C1}$, $I_{C2}$, as described above and $I_{ES}$, which is the beam current at the extraction system. The second data set and third data set (and more) are then obtained at the different drive currents. As such, the data sets include values of the same operating parameters, but at different drive currents.

At 418, the data sets may be analyzed to select a new drive current. For embodiments in which only one operating parameter is monitored (e.g., the target current), the new drive current may be selected based on the data set that includes a more desirable target current. For embodiments that obtain data regarding multiple operating parameters, the method 400 may include selecting the new drive current by filtering away possible drive current values. FIG. 10 illustrates this example. As shown, ten data may be obtained in which each data set includes a value for $I_T$, $I_{C1}$, $I_{C2}$, and $I_{ES}$, at a different drive current. For example, the ten data sets may be obtained at 409.30 A, 409.40 A, 409.50 A, 409.60 A, 409.70 A, 409.80 A, 409.90 A, 410.00 A, 410.10 A, and 410.20 A. In some embodiments, the drive current is swept back-and-forth within the designated range. For example, after obtaining the above data sets, the drive current may be decreased and new data sets may be obtained at 410.20 A, 410.10 A, 410.00 A, 409.90 A, and so on. This sweeping processes may be repeated a plurality of times until a plurality of data sets for each drive current have been obtained. As an example only, the sweeping and detecting processes may take twenty to thirty seconds.

FIG. 10 illustrates the method 400. The method 400 may effectively filter or sift out potential drive currents by effectively selecting for a first desired quality, then a second desired quality, then an optional third desired quality, and so on. For example, as shown in FIG. 10, the analyzing, at 418 (FIG. 9), may include a first operation 420 of identifying data sets that have a sufficient extraction current. Alternatively, the first operation 420 may include identifying a predetermined number of data sets that have the best extraction currents. In FIG. 10, the first operation 420 has identified six data sets. The analyzing at 418 may include a second operation 422 of identifying data sets that have a sufficient target current from among the previously-selected data sets in the first operation 420. Alternatively, the second operation 422 may include identifying a predetermined number of data sets that have the best target currents from among the previously-selected data sets in the first operation 420. In FIG. 10, the second operation 422 has identified three of the six data sets. The analyzing at 418 may then include a third operation 424 of identifying the data set that has the best collimator currents from among the previously-selected data sets in the second operation 422. For example, the best collimator currents may identify the beam with the narrowest width. In FIG. 10, the third operation 424 has identified the sixth data set as having the best collimator currents. In this example, the drive current that was used when the sixth data set was obtained may become the new drive current for operation.

As shown in FIG. 9, the method 300 may include repeating the monitoring, obtaining, and analyzing operations at 414, 416, and 418, respectively, to find new drive currents. The operations at 414, 416, and 418 may be continuously repeated until the end of the session. Alternatively, the operations at 414, 416, and 418 may be repeated in accordance with a designated schedule. For example, the operations at 414, 416, and 418 may be repeated every 10 minutes, 20 minutes, 30 minutes, etc. It should be understood that the above examples for controlling a drive current of the radioisotope production system 100 are illustrative and that other embodiments may control the drive current in different manners.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

This written description uses examples to disclose the various embodiments, and also to enable a person having ordinary skill in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or the examples include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, or the like). Similarly, the programs may be stand alone programs, may be incorporated as subroutines in an operating system, may be functions in an installed software package, or the like. The various embodiments are not limited to the arrangements and instrumentality shown in the drawings.

What is claimed is:

1. A radioisotope production system comprising:

an electrical field system and a magnetic field system configured to direct a particle beam of charged particles along a beam path within an acceleration chamber, the magnetic field system including a magnet yoke and an electromagnet that is energized by a drive current to generate a magnetic flux into the acceleration chamber for controlling the particle beam;

a target system configured to hold a target material and receive the particle beam;

an extraction unit, wherein the particle beam is configured to pass through the extraction unit and exit the acceleration chamber toward the target system; and a monitoring system including a processing unit that, for a plurality of times during a production session of the radioisotope production system, is configured to:

(a) determine an operating parameter of the radioisotope production system, the operating parameter including a target current or a function of the target current, the target current being detected as the particle beam is incident upon the target material; and (b) change the drive current, thereby changing the magnetic flux, based on the operating parameter;

wherein the monitoring system is configured to obtain data of the operating parameter at one or more drive currents, wherein the monitoring system is configured to analyze the data to identify a new drive current, the monitoring system configured to change the drive current to the new drive current;

wherein the monitoring system is configured to obtain the data by sweeping the drive current back-and-forth within a designated range such that the data of the operating parameter includes values of the operating parameter at different drive currents; and wherein the data includes data sets, each of the data sets includes a first operating parameter and a second operating parameter for a designated drive current, the monitoring system configured to select a first sub-group of the data sets based on the first operating parameters and configured to select a second sub-group of the data sets from the first sub-group based on the second operating parameters, the new drive current being based on the designated drive currents of the data sets in the second sub-group.

2. The radioisotope production system of claim 1, wherein the operating parameter includes at least one of a beam current that is detected at a designated location along the beam path, a beam profile of the particle beam, a beam quality factor, or a drive current of an ion source system, and wherein the operating parameter is detected at different values of the drive current of the electromagnet.

3. The radioisotope production system of claim 1, wherein the operating parameter is a plurality of operating parameters, wherein each of the plurality of operating parameters is determined at different values of the drive current, the monitoring system changing the drive current based on the plurality of operating parameters.

4. The radioisotope production system of claim 3, wherein the operating parameters are beam parameters of the particle beam that correspond to different locations along the beam path.

5. The radioisotope production system of claim 3, wherein the plurality of operating parameters includes a collimator current of the particle beam at a collimator.

6. The radioisotope production system of claim 3, wherein the target system is configured to hold two separate target materials and the particle beam is directed toward each of the target materials, the plurality of operating parameters including the target current associated with each of the target materials.

7. The radioisotope production system of claim 1, wherein the monitoring system determines a beam quality factor based on the operating parameter, wherein the beam quality factor is determined at different values of the drive current and the drive current is changed based on the beam quality factor.

8. The radioisotope production system of claim 7, further comprising an ion source system having an operating parameter that is indicative of an output of an ion source, wherein the beam quality factor is a function of the operating parameter of the ion source system and a function of a beam current that is detected at a designated location along the beam path.

9. A radioisotope production system comprising:

an electrical field system and a magnetic field system configured to direct a particle beam of charged particles along a beam path within an acceleration chamber, the magnetic field system including a magnet yoke and an electromagnet that is energized by a drive current to generate a magnetic flux into the acceleration chamber for controlling the particle beam;

a target system configured to hold a target material and receive the particle beam;

a monitoring system including a processing unit that, for a plurality of times during a production session of the radioisotope production system, is configured to:

(a) determine an operating parameter of the radioisotope production system as the particle beam is directed toward the target material; and (b) change the drive current, thereby changing the magnetic flux, based on the operating parameter;

wherein the processing unit is configured to determine a beam quality factor based on the operating parameter, wherein the beam quality factor is determined at different values of the drive current and the drive current is changed based on the beam quality factor; and wherein the processing unit is configured to repeatedly:

(a) change the drive current by increasing or decreasing the drive current until the beam quality factor worsens and then (b)(1) change the drive current in an opposite direction until the beam quality factor worsens or (b)(2) select a new drive current based on a value of the drive current when the beam quality factor worsened.

10. The radioisotope production system of claim 9, wherein the operating parameter is a target current or is a function of the target current, the target current being a current reading from the target system as the particle beam is incident upon the target material.

11. The radioisotope production system of claim 10, further comprising an ion source system having an operating parameter that is indicative of an output of an ion source, wherein the beam quality factor is a function of the operating parameter of the ion source system and a function of the target current.

* * * * *